United States Patent [19]

Michelson

[11] Patent Number: 4,706,325

[45] Date of Patent: Nov. 17, 1987

[54] FILM CLEANER

[76] Inventor: Manfred G. Michelson, 4396 Park Vicente, Calabasas, Calif. 91311

[21] Appl. No.: 883,618

[22] Filed: Jul. 9, 1986

[51] Int. Cl.[4] ..... B08B 11/02; A46B 13/02

[52] U.S. Cl. ..... 15/308; 15/77; 15/100; 15/374; 134/64 P; 134/122 P

[58] Field of Search ..... 15/306 A, 308, 309, 15/374; 134/64 P, 122 P

[56] References Cited

U.S. PATENT DOCUMENTS 3,470,576 10/1969 Troia ..... 15/347

3,593,642 7/1971 Beicheiraz et al. ..... 134/122 P

*Primary Examiner*—Harvey C. Hornsby

*Assistant Examiner*—Corinne M. Reinckens

*Attorney, Agent, or Firm*—Christie, Parker & Hale

[57] ABSTRACT

An elongated film strip is cleaned by two pairs of rotary brushes with soft bristles contacting opposite sides of the film strip traveling between the two pairs of brushes. Each pair of brushes is placed at an angle to the direction of film travel for brushing dirt particles away from the center of the film. The top pair of brushes and the bottom pair of brushes are arranged so that one brush in each pair brushes the particles from the central region of the film toward one edge of the film, while the other brush on the same side of the film brushes particles away from the central region of the film toward the other edge of the film. The brushes avoid contact with perforations on the edge of the film which would result in particles lodged in the perforations being brushed toward the central region of the film. A separately electrically conductive vacuum tube contacts each brush after the brush contacts the film. The vacuum tube discharges static electricity from the brush and vacuums the discharged particles away from the brush.

18 Claims, 3 Drawing Figures

FILM CLEANER

FIELD OF THE INVENTION

This invention relates to film cleaners, and more particularly to a film cleaning system having rotary brushes for contacting a traveling film strip to brush dirt particles away from the film.

BACKGROUND OF THE INVENTION

Motion picture film is commonly reproduced on a film printer. It is important to clean the film before it is exposed in the printer, especially since thousands of copies may be made from a single negative. Fine dust particles are inherently present in the film when it comes from the manufacturer. The film also can get dirty during copying, from contact with film drive rollers in the printer. Dirt particles become lodged in the perforations along each edge of the film, and these dirt particles can find their way onto the exposure areas of the film when running through a printer, or even a film cleaning machine. It is important to remove dirt particles from the film as completely as possible in order to ensure quality reproductions in the film copies.

SUMMARY OF THE INVENTION

Briefly, this invention provides a film cleaning system for cleaning an elongated traveling film strip. The film cleaner includes a pair of rotary brushes spaced apart along the direction of film travel. The brushes are mounted for direct contact with the same side of the film strip for brushing dirt particles away from the film. The brushes are mounted on an angle to the direction of film travel so that one brush contacts the film only from the central region of the film to one edge of the film, and the other brush contacts the film only the central region of the film to the other edge of the film. The brushes are rotated in a direction for brushing particles only from the central region of the film toward its opposite edges. This avoids brushing particles toward the central region of the film from perforations which may be present along each edge of the film.

In one embodiment, an electrically conductive element communicates with each brush after the brush contacts the film to discharge static electricity from particles removed from the film by the brush. A vacuum device adjacent the brush then removes the discharged particles from the brush so that particles removed by the brushes are not brushed back onto the film surface.

These and other aspects of the invention will be more fully understood by referring to the following detailed description and the accompanying drawings.

DRAWINGS

DETAILED DESCRIPTION

Figure 1:
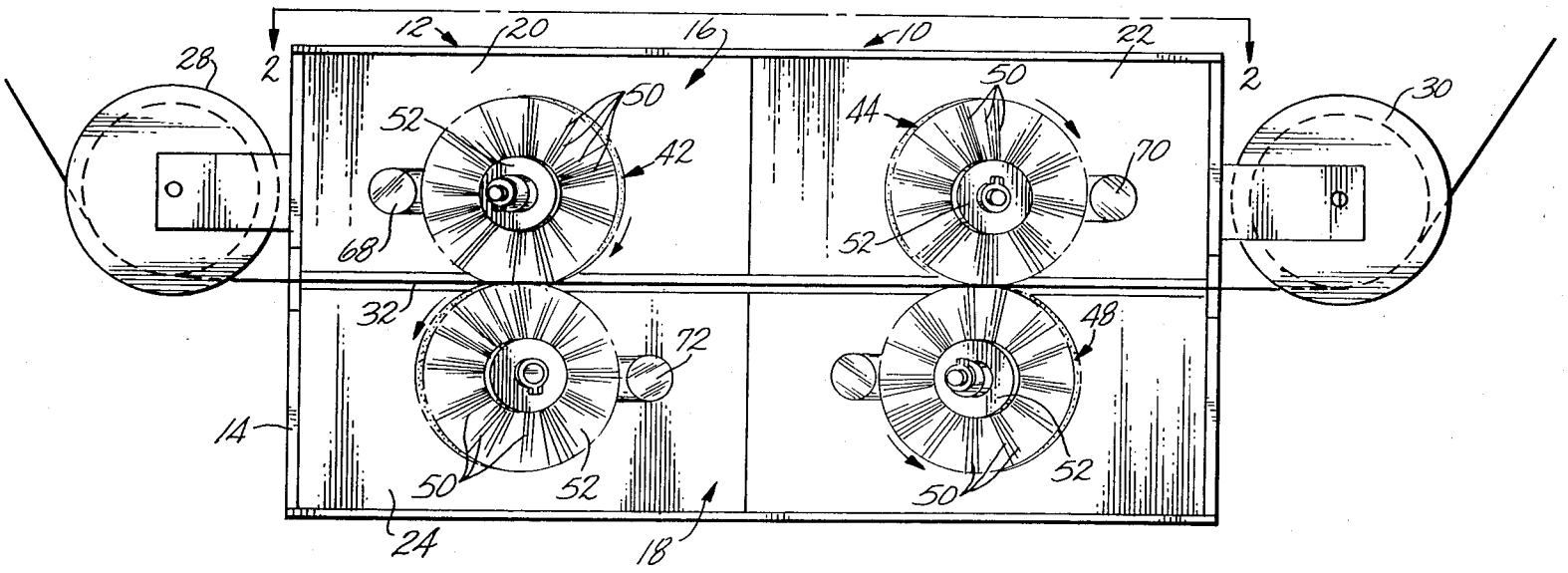
FIG. 1 is a front elevation view showing a film cleaner according to principles of this invention.
Figure 2:
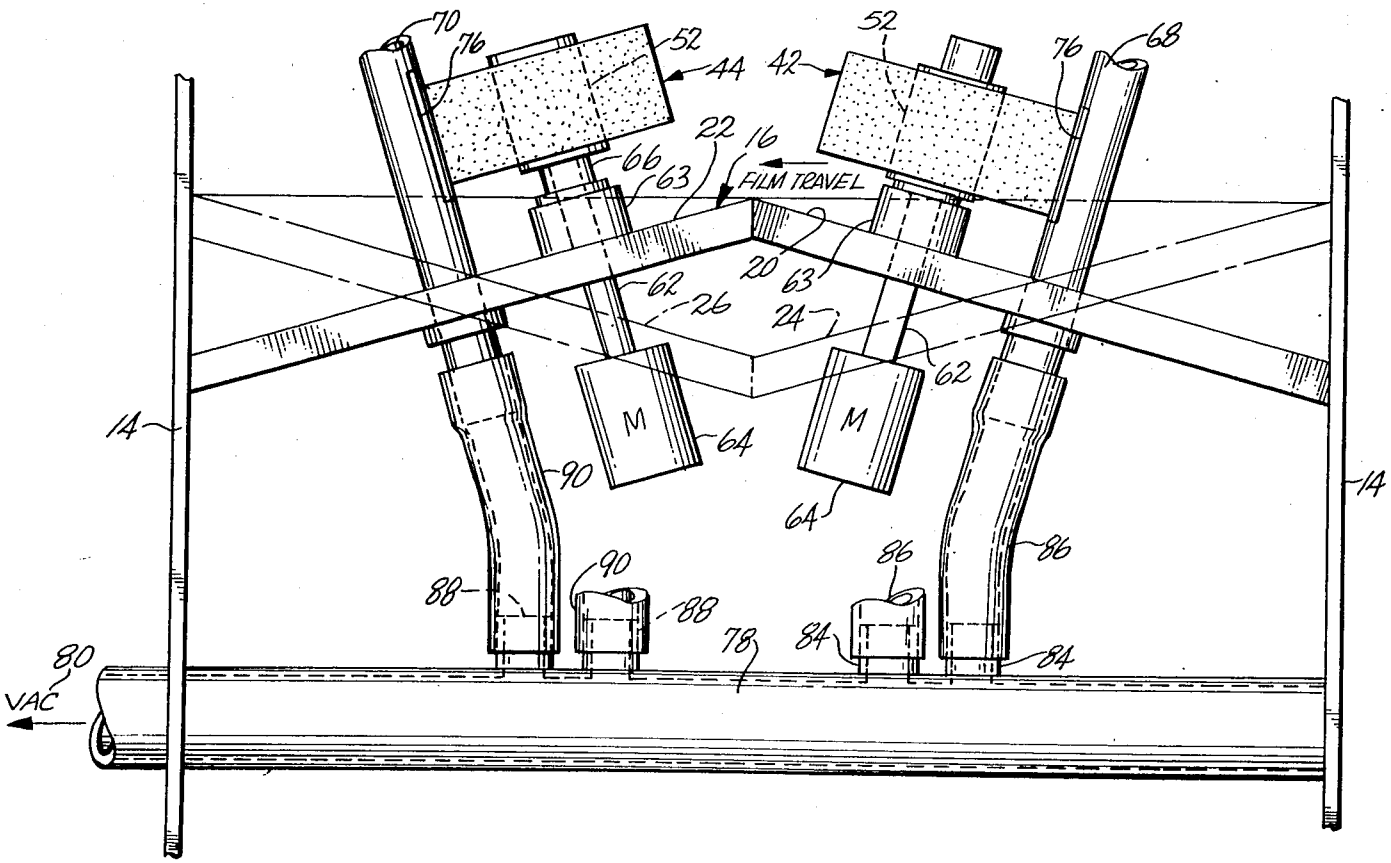
FIG. 2 is a semi-schematic plan view taken on line 2—2 of FIG. 1.

A film cleaner 10 includes a housing 12 having a front face shown in FIG. 1. Portions of the housing shown in the top plan view of FIG. 2 include rigid side panels 14 spaced apart along opposite sides of the housing, and V-shaped upright upper and lower brush-supporting walls 16 and 18, respectively, extending between the side panels 14 of the housing. (The top plan view of FIG. 2 is illustrated with the film cleaning brushes at the top of the figure. Therefore, components of the film cleaner shown on the left and right sides of FIG. 1 are reversed and are shown on the right and left sides, respectively, of FIG. 2.) The lower V-shaped wall 18 is shown in phantom lines only in FIG. 2 for clarity. The brushes mounted on the lower V-shaped wall 18 are not shown in FIG. 2 also for clarity. The V-shaped upper wall 16 includes an elongated front section 20 extending along an angle and joined at its apex to an elongated rear section 22 extending at an angle in the opposite direction so that the front and rear wall sections 20 and 22 form the V-shaped wall 16 in the top plan view of FIG. 2. The lower V-shaped wall 18 has an elongated front section 24 extending at an angle which bisects the path of the front section 20 of the upper wall 16. The lower wall 18 also has an elongated rear section 26 joined to the end of the lower front wall section 24 and extending at an angle which bisects the path of the rear section 22 of the upper wall 16. The upper and lower V-shaped walls are therefore angled in opposite directions with the upper wall projecting outwardly from the housing and the lower wall projecting inwardly toward the housing, as best illustrated in FIG. 2. The front and rear upper and lower V-shaped walls 16 and 18 extend at angles for angularly mounting rotary film cleaning brushes in a manner described in more detail below.

As shown best in FIG. 1, a pair of film rollers 28 and 30 are mounted on the side panels 14 at opposite ends of the housing. The film rollers are each mounted to rotate about axes extending parallel to one another for guiding an elongated film strip 32 along a path having an axial direction of travel through the housing 12 perpendicular to the axes of rotation of the film rollers 28 and 30. The film strip, shown best in FIG. 3, may have the usual upper and lower rows of perforations 34 and 36 extending along upper and lower edges 38 and 40 of the film. The invention also can be used to clean film having one row of perforations or no perforations. The film strip requires cleaning prior to copying of the film in order to enhance film quality in the copies being run on the printer. The film emulsion can contain foreign particles such as dust, lint and fine dirt particles when coming from the film manufacturer. In addition, other foreign particles can be picked up by the film from film drive rollers in the film copying machine which transports the film. The perforations along opposite edges of the film are common places where dirt particles become lodged. These particles should be removed during film cleaning to avoid later being transmitted to the exposure area along the central portion of the film.

The film cleaner includes two pairs of rotary brushes each for brushing opposite faces of the film as it travels through the housing. The pairs of brushes include a pair of axially spaced apart upper brushes 42 and 44 mounted on the front and rear wall sections 20 and 22, respectively, above the film strip; and a pair of axially spaced apart lower brushes 46 and 48 mounted on the front and rear wall sections 24 and 26, respectively, below the film. Each rotary brush includes a cylindrical core 52 with radially extending bristles 50 mounted on the core in a tufted arrangement for forming a continuous cylindrical brushing surface at the periphery of the brush. The bristles are made from any flexible and soft material known to be suitable for brushing foreign matter from film so as to not scratch the traveling film as the brushing surfaces are rotated into direct contact with the film surface.

Figure 3:
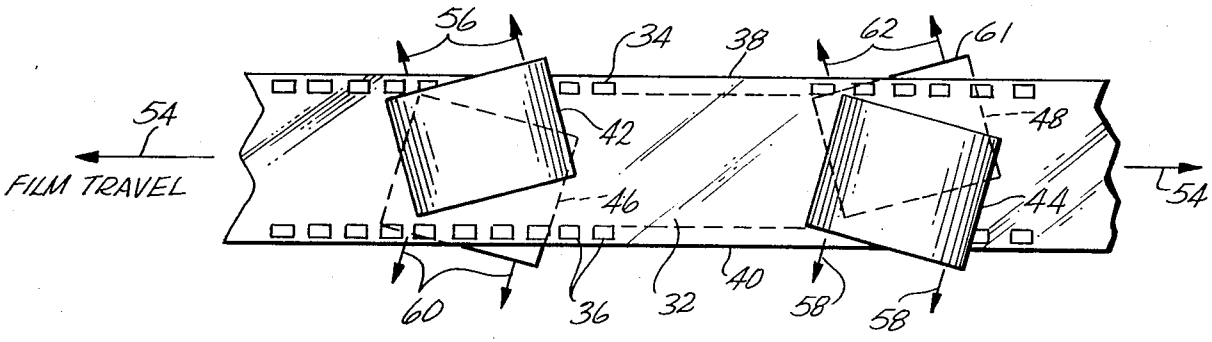
FIG. 3 is a fragmentary semi-schematic plan view illustrating the angular mounting of the rotary brushes of the film cleaner.

The brushes are mounted so that the front pair of upper and lower brushes 42 and 46 above and below one another and are pressed into direct contact with the upper and lower faces of the film as it travels through the front portion of the housing. The rear pair of upper and lower brushes 44 and 48 are above and below one another and pressed into contact with the upper and lower faces of the film in the rear portion of the housing. The pair of brushes are positioned so they are in direct pressure-applying contact with opposite faces of the film at all times as the film travels along a linear path between the brushes. The peripheral areas of the brushes in contact with the film normally bend or flex under the applied pressure. Each of the brushes is mounted at an angle relative to the direction of travel of the film through the housing so that the brushes cooperate to brush particles from both sides of the film toward the edges of the film, away from the center of the fim. The pair of upper brushes 42 and 44 are arranged so that one brush brushes particles angularly toward one edge of the film upper face away from the central portion of the film, while the other brush brushes particles angularly from the central portion of the film upper face toward the opposite edge of the film. The pair of brushes on the lower side of the film also are arranged so that one brush brushes particles angularly from the central region of the film bottom face toward one edge of the film, while the other brush brushes particles angularly from the central region of the film bottom face toward the opposite edge of the film. Each brush is mounted at an angle relative to the direction of film travel in the sense that the axis of rotation of each brush intersects the axial direction of travel of the film at an angle less than 90° and greater than 0°. In the preferred embodiment, the angle between the axis of rotation of each brush (shown in phantom lines in FIG. 3) and the direction of film travel illustrated by the arrow 54 in FIG. 3 is about 15°. In the illustrated embodiment, the brushes on the upper side of the film strip are arranged so that the brushing surface of the front brush 42 is held in contact with an area of the upper film surface extending from most of the central region of the film to the upper edge 38 of the film so as to overlap the row of perforations 34 adjacent the upper edge of the film; and the brushing surface of the rear brush 44 contacts an area of the upper film surface extending from most of the central portion of the film to the lower edge 40 of the film for overlapping the row of perforations 36 adjacent the lower edge of the film. The front upper brush 42 is rotated in a clockwise direction for brushing particles from the upper half of the film surface toward the upper edge of the film, as illustrated by the arrows 56 in FIG. 3, and the rear upper brush 44 is rotated so as to brush particles away from the central region of the film toward the lower edge 40 of the film, as illustrated by the arrows 58 in FIG. 3. The pair of lower brushes 46 and 48 are arranged so that the brushing surface of the lower front brush 46 contacts an area extending from most of the central portion of the film to the lower edge 40 of the film to overlap the lower row of perforations 36, and the brushing surface of the lower rear brush 48 contacts an area extending from most of the central portion of the film to the upper edge of the film to overlap the upper row of perforations 34. The brushes on the lower side of the film are rotated so that the lower front brush 46 is rotated in a counterclockwise direction to brush particles away from the central portion of the brush toward the lower edge of the brush, as illustrated by the arrows 60 in FIG. 3, and the lower rear brush 48 is rotated in a counterclockwise direction to brush particles from the central region of the film toward the upper edge 38 of the film, as illustrated by the arrows 61.

FIG. 2 illustrates a preferred system for mounting each of the brushes. Only the upper pair of brushes are illustrated in FIG. 2 for clarity, inasmuch as a similar mounting system is used for the lower pair of brushes. Each cylindrical core 52 of the upper pair of brushes is driven by a corresponding elongated shaft 62 mounted in a bearing 63 on the front wall of the housing. Each shaft extends through the wall of the housing and is driven by a separate motor 64 mounted inside the housing. In one embodiment, each motor is preferably a small 0.5 w, 115 v, 60 Hz induction motor. Brush speed is relatively low, i.e., preferably 60 rpm, to avoid the centrifugal force of the motor from dislodging any dirt from the brush. The drive shafts 62 from the motors extend through the walls 20 and 22 and their associated bearings 63 along a path generally perpendicular to the wall and to the length of the brush as illustrated in FIG. 2. A spacer 66 is mounted between the bearing 63 and the core of the rear upper brush 44 positions the brush 44 over the outermost portion of the film strip. The front brush 42 is mounted without a spacer to position it on the inner portion of the film passing through the housing. The brushes on the lower side of the film are similarly mounted, with the front lower brush having a spacer for positioning the brush over the outer portion of the film, while the rear lower brush is mounted without a spacer for contact with the inner portion of the film.

After each brush has contacted the film, it contacts an electrically conductive tube with a vacuum opening for vacuuming the dirt from the brush. As shown best in FIG. 1, a front upper conductive vacuum tube 68 contacts the outer periphery of the front upper brush 42, and a rear upper conductive vacuum tube 70 contacts the outer periphery of the rear upper brush 44. Similarly, a front lower conductive vacuum tube 72 contacts the outer periphery of the lower front brush 46, and a lower rear electrically conductive vacuum tube 74 contacts the outer periphery of the rear lower brush 48. The conductive vacuum tubes each extend perpendicularly through the upright wall portions of the housing to which their corresponding brushes are mounted. Each tube has a long narrow slit 76, best illustrated in FIG. 2, positioned at the point where the periphery of the brush contacts the tube, so that particles can be drawn away from the brush by a vacuum applied to the vacuum slot.

FIG. 2 best illustrates the vacuum system in which an elongated main vacuum line 78 extends through the interior of the housing. An exterior portion of the vacuum line extends through a sidewall of the housing and is connected to a vacuum source 80 such as a common vacuum cleaner. A first pair of short vacuum outlet connections 84 from the main vacuum line are sealed to flexible tubular conduits 86 which, in turn are connected to the front pair of conductive vacuum tubes 68 and 72 above and below the front portion of the film. Similarly, a pair of rear vacuum line connections 88 extend from the main vacuum line for connection to tubular conduits 90 which, in turn, are sealed to the pair of rear vacuum tubes 70 and 74. The vacuum tubes are preferably made from an electrically conductive material, such as aluminum steel or chromeplated brass, for discharging static electricity from the brush. Each brush is rotated into direct contact with a corresponding conductive tube so that static electricity, which will normally hold the particles to the brush, will discharge to loosen the attraction of the dirt to the brush so that the dirt particles can then be sucked into the vacuum slot in the vacuum tube. A small vacuum slot is used in each tube to provide a high velocity vacuum to remove particles effectively. It is preferred to use a vacuum of about four to twelve inches of water with a narrow slot extending the full width of each brush. It is also preferred that the vacuum slot portion of the tube is in direct contact with the periphery of the brush to effectively remove particles. Preferably, the vacuum tubes are each electrically grounded, and a preferred technique is to mount the tubes directly to the housing then electrically ground the housing.

It is of critical importance that each brush contact only approximately half the film surface and then brush particles toward only one edge of the film, without contacting or brushing particles toward the opposite edge of the film. As described above, continuous and pressure contact betwen each brush and the traveling film also is of critical importance. Inasmuch as fine dirt particles can become lodged in the perforations along both edges of the film, the brushes are arranged so that each brush does not apply this pressure contact to both rows of perforations, or brush particles from the perforations toward the center of the film.

Thus, the present invention provides an effective means for cleaning film. The film cleaner has two brushes on each side of the film, and the brushes are each placed at an angle relative to the direction of travel of the film. The brushes brush away dirt from the center of the film toward the edges. Most of the dirt on the film is in the perforation areas of the film, and the brushes are arranged so they do not brush dirt from these areas of the film into the central image area of the film. The bristles are in direct contact with the film, and after the brush has contacted the film, it contacts an electrically conductive tube with a vacuum slot for removing dirt particles. The tube is conductive in order to discharge static electricity from the brush. The vacuum slot in each tube is substantially smaller than the tube diameter in order to obtain a high air velocity at the velocity slot. Brush speed is relatively low to avoid centrifugal force dislodging dirt from the brush. Since the brushes are at an angle, they can clean the film independently of the direction of film travel.

I claim:

1. A film cleaner for cleaning an elongated traveling film strip, the film cleaner comprising:

a pair of rotary brushes spaced apart axially along the direction of travel of the film strip;

means mounting the brushes for direct contact with the same side of the film strip for brushing dirt particles away from the film, the brushes being mounted on an angle relative to the direction of film travel so that one brush contacts the film from only the central region of the film to one edge of the film and the other brush contacts the film from only the central region of the film to the other edge of the film; and means for rotating the brushes so that each brush is rotated in a direction for brushing particles only from the central region of the film strip toward its opposite edges, thereby avoiding brushing of particles toward the central region of the film from a region along each edge of the film strip.

2. Apparatus according to claim 1 including an electrically conductive element contacting each brush after it contacts the film for discharging static electricity from particles removed from the film by the brush.

3. Apparatus according to claim 2 including vacuum means for removing the discharged particles from the brush.

4. Apparatus according to claim 3 in which the vacuum means comprises a tube with a narrow vacuum slot in contact with the periphery of the brush to obtain high air velocity at the vacuum slot.

5. Apparatus according to claim 3 in which the electrically conductive element and vacuum means comprise an electrically conductive vacuum tube having an opening to which the vacuum is applied adjacent the periphery of the brush.

6. Apparatus according to claim 3 including a second pair of brushes spaced apart axially along the opposite side of the film strip and arranged for direct contact with the film strip and mounted in angular positions so that the brushes on the other side of the film also brush dirt particles only from the central region of the film toward the opposite edges of the film while avoiding brushing of particles toward the central region of the film from perforations along each edge of the film.

7. Apparatus according to claim 1 including a second pair of brushes spaced apart axially along the opposite side of the film strip and arranged for direct contact with the film strip and mounted in angular positions so that the brushes on the other side of the film also brush dirt particles from the central region of the film toward the opposite edges of the film while avoiding brushing of particles toward the central region of the film from perforations along each edge of the film.

8. Apparatus according to claim 1 including means for rotating the brushes slowly to prevent centrifugal force from the rotating brush from directing removed particles back onto the film surface.

9. A film cleaner for cleaning an elongated traveling film strip, the film cleaner comprising:

a pair of rotary brushes spaced apart axially along the direction of travel of the film strip and means mounting the brushes for continuous and direct pressure contact with the same side of the film strip for brushing dirt particles away from the film, the brushes being mounted on an angle relative to the direction of film travel so that the brushes each contact the central region of the film and are rotated to brush particles from the central region of the film strip toward opposite edges of the film strip thereby avoiding brushing of particles toward the central region of the film from a region along each edge of the film strip.

10. Apparatus according to claim 9 including an electrically conductive element contacting each brush after it contacts the film for discharging static electricity from particles removed from the film by the brush.

11. Apparatus according to claim 10 including vacuum means for removing the discharged particles from the brush.

12. Apparatus according to claim 11 in which the vacuum means comprises a tube with a narrow vacuum slot in contact with the periphery of the brush to obtain high air velocity at the vacuum slot.

13. Apparatus according to claim 11 in which the electrically conductive element and vacuum means comprise an electrically conductive vacuum tube having an opening to which the vacuum is applied adjacent the periphery of the brush.

14. Apparatus according to claim 11 including a second pair of brushes spaced apart axially along the opposite side of the film strip and arranged for direct contact with the film strip and mounted in angular positions so that the brushes on the other side of the film also brush dirt particles from the central region of the film toward the opposite edges of the film while avoiding brushing of particles toward the central region of the film from perforations along each edge of the film.

15. Apparatus according to claim 9 including a second pair of brushes spaced apart axially along the opposite side of the film strip and arranged for direct contact with the film strip and mounted in angular positions so that brushes on the other side of the film also brush dirt particles from the central region of the film toward the opposite edges of the film while avoiding brushing of particles toward the central region of the film from perforations along each edge of the film.

16. Apparatus according to claim 9 including means for rotating the brushes slowly to prevent centrifugal force from the rotating brush from directing removed particles back onto the film surface.

17. A film cleaner for cleaning an elongated traveling film strip, the film cleaner comprising:

a pair of rotary brushes spaced apart axially along the direction of travel of the film strip;

means mounting the brushes for continuous and direct pressure contact with the same side of the film strip for brushing dirt particles away from the film, the brushes being mounted on an angle relative to the direction of film travel so that the brushes each contact the central region of the film and are rotated to brush particles only from the central region of the film strip toward opposite edges of the film strip thereby avoiding brushing of particles toward the central region of the film from a region along each edge of the film strip;

an electrically conductive element contacting each brush after it contacts the film for discharging static electricity from particles removed from the film by each brush; and vacuum means for removing the discharged particles from each brush.

18. Apparatus according to claim 17 in which the electrically conductive element and vacuum means comprise an electrically conductive vacuum tube having an opening to which the vacuum is applied adjacent the periphery of the brush.

* * * * *